US008356879B1

(12) United States Patent
Tallada et al.

(10) Patent No.: US 8,356,879 B1
(45) Date of Patent: Jan. 22, 2013

(54) NOZZLE PLATE CLEANING

(75) Inventors: Alex Andrea Tallada, Barcelona (ES); Marta Coma Vives, Barcelona (ES); Ángel Martínez Barambio, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/229,128

(22) Filed: Sep. 9, 2011

(51) Int. Cl.
*B41J 2/165* (2006.01)

(52) U.S. Cl. ..... 347/22

(58) Field of Classification Search ..... 347/19, 347/20, 22, 33
See application file for complete search history.

(56) References Cited

U.S. PATENT DOCUMENTS

| | | | | |
|---|---|---|---|---|
| 6,388,758 | B2 | 5/2002 | Kawanabe et al. | |
| 6,789,876 | B2 * | 9/2004 | Barclay et al. | 347/37 |
| 7,591,519 | B2 * | 9/2009 | Tatsumi | 347/9 |
| 7,717,540 | B1 | 5/2010 | King et al. | |
| 2008/0266342 | A1 | 10/2008 | Steinfield et al. | |
| 2010/0272460 | A1 | 10/2010 | Zona et al. | |
| 2010/0315463 | A1 * | 12/2010 | Escude et al. | 347/33 |

FOREIGN PATENT DOCUMENTS

| | | | |
|---|---|---|---|
| GB | 2352688 | A | 2/2001 |

* cited by examiner

*Primary Examiner* — An Do

(57) ABSTRACT

An example printer or method involves recognizing artifacts in a digital image of at least a part of a nozzle plate, and triggering a nozzle plate cleaning routine if the recognized artifacts cover more than a predetermined threshold.

15 Claims, 6 Drawing Sheets

NOZZLE PLATE CLEANING

BACKGROUND

During printing amounts of print fluid may be left behind on the nozzle plate, sometimes forming unwanted artifacts near the nozzles. In some printers, the nozzle plate is cleaned during printing at a predetermined frequency. A cleaning routine may involve passing a wiper over the nozzle plate. In some instances, the cleaned off artifacts are collected by an exchangeable cassette.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
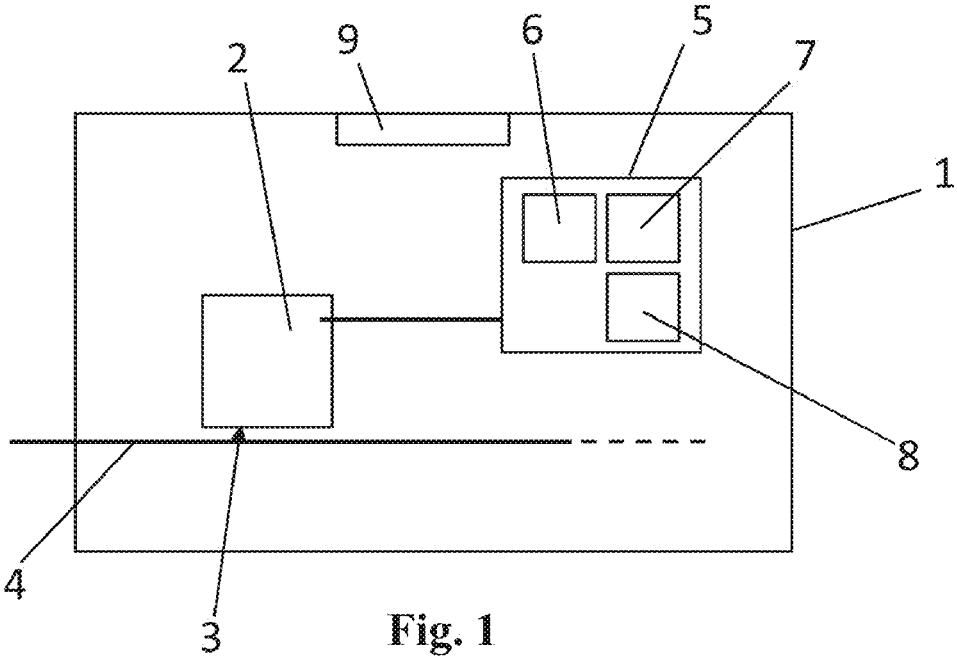
FIG. 1 shows a diagram of an example of a printer.

FIG. 1 shows an example of a printer 1 in a diagrammatic cross sectional view. The printer 1 includes a printhead 2. The printhead 2 includes a nozzle plate 3. The nozzle plate 3 includes nozzles for ejecting fluid. For example, the printhead 2 is one of a scanning printhead or a page wide array (PWA) printhead. In use, a substrate 4 advances with respect to the nozzle plate 3 for printing.

The printer 1 includes a printer circuit 5 for instructing the printer 1. For example, the printer circuit 5 includes a control circuit 6, a memory arrangement 7 and/or a formatter 8. For example, the control circuit 6 includes a digital and/or analog integrated circuit. For example, the formatter 8 includes a raster image processing device. The printer circuit 5 includes hardware and firmware, and may include software. The printer 1 may include an operator panel 9 for receiving operator instructions. The operator panel 9 is connected to the printer circuit 5. The operator panel 9 may include a touch screen.

Figure 2:
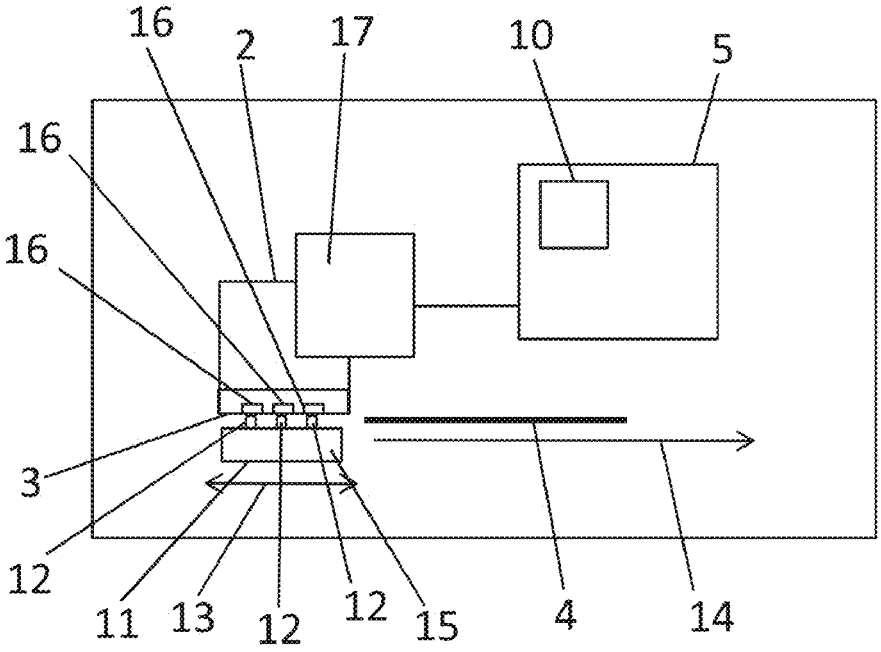
FIG. 2 shows a diagram of an example of a printer and a computer program product.

FIG. 2 shows another example of a printer 1 in a diagrammatic cross sectional view. In the shown example, the printer circuit 5 includes a computer program product 10 storing a computer program that includes instructions. For example, the computer program product 10 may be stored in the memory arrangement 7 or on an external data storage. The computer program product may be part of the software or hardware.

The printer 1 includes a service station 11 for cleaning the nozzle plate 3. In an example, the service station 11 includes wipers 12 or other cleaning members that during a cleaning routine wipe the nozzle plate 3. The wipers 12 or other cleaning members may remove artifacts such as paddles, dirt, fluids and/or crusts of the nozzle plate 3. In an example, the wipers 12 are arranged to move with respect to the nozzle plate 3 in a direction 13 parallel to the substrate advance direction 14 and/or perpendicular to a printhead scanning direction, if the printhead 2 is a scanning printhead. The surface station 11 may include an exchangeable cassette 15 for collecting said artifacts when the wipers 12 or other cleaning members move over the nozzle plate 3. For example, the cassette may be arranged to be exchanged for example when it has collected a certain amount of artifacts. For example, the cassette may be taken out, cleaned and put back, or replaced by a new one.

The printhead 2 includes actuators 16 for ejecting fluid from the nozzles of the nozzle plate 3. For example, the actuators 16 include resistors. For example, the actuators 16 include thermal resistors for TIJ (Thermal InkJet) printing or piezo elements for PIJ (Piezo InkJet) printing. For example, the printer 1 includes a irradiator 17 for irradiating printed fluid. For example, the irradiator 17 may include at least one of a heating source, an Ultra-Violet irradiation source, an Infra-Red irradiation source or another irradiation source. During printing, elements such as an ambient temperature, thermal resistors and/or irradiators 17 may intentionally or unintentionally heat up a nozzle plate 3. For example, thermal resistors may be located close to, or in, the nozzle plate 3 and may heat the nozzle plate 3 at firing. In an example, the irradiator 17 may be connected to the printhead 2 for heating the printed fluid while passing over the substrate 4, which in turn may influence nozzle plate temperature. Also ambient temperatures may influence the nozzle plate temperature. For example, depending on how much a respective nozzle fires, a temperature of at least a part of the nozzle plate 3 may be higher than approximately 55° C., or higher than approximately 60° C., or higher than approximately 65° C. In some examples it may be that at relatively high temperatures certain fluids on a nozzle plate 3 may dry or adhere relatively fast. Unwanted artifacts such as paddles, dirt, fluids and/or crust may accumulate on the nozzle plate 3 and may in turn be at least partially cleaned off by the service station 11 through cleaning routines.

Figure 3:
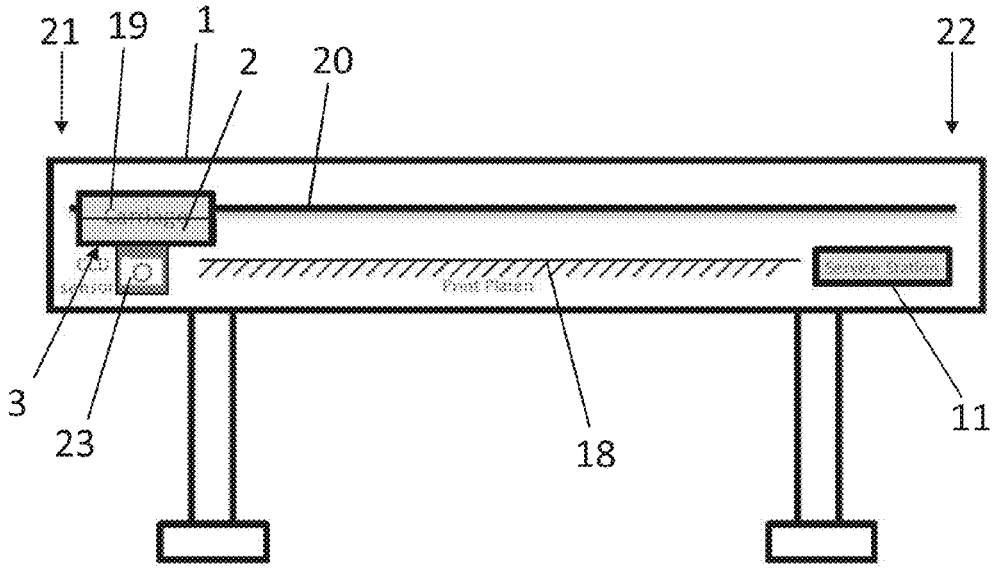
FIG. 3 shows an example of a printer in front view, in a first state.

FIG. 3 shows an example of a printer 1 in a cross sectional front view, in a first state. The printer 1 may be a large format printer. The printer 1 includes a print platen 18, for supporting the substrate 4. The printer 1 includes a scanning printhead 2. The printer 1 is provided with a carriage 19 and a scanning axis 20 for scanning the printhead 2. In use, the printhead 2 scans between two ends 21, 22 of the scanning axis 20. The printer 1 includes an image sensor 23. The image sensor 23 may be a CCD (Charge-Coupled Device) sensor, a CMOS (Complementary Metal-Oxide Semiconductor) sensor, a scanner, or any other suitable digitally connectable optical device. The image sensor 23 is configured to take a digital image of at least a part of the nozzle plate 3. The printer 1 is shown in a first state wherein the image sensor 23 takes a digital image of the nozzle plate 3.

In the shown example, the image sensor 23 is provided near a first end 21 of the scanning axis 20 and the service station 11 is provided near a second end 22 of the scanning axis 20, opposite to the first end 21. The print platen 18 may be arranged between the image sensor 23 and the service station 11. The image sensor 23 may be arranged near the first end 21 so as to capture a digital image of the nozzle plate 3 between print passes. In another example, the image sensor 23 may be located near the second end 22 or near both ends 21, 22 (not shown). The printer circuit 5 is configured to trigger the image sensor 23 to take a digital image of the nozzle plate 3 when the nozzle plate 3 is near a respective end 21, 22 of a print pass.

Figure 4:
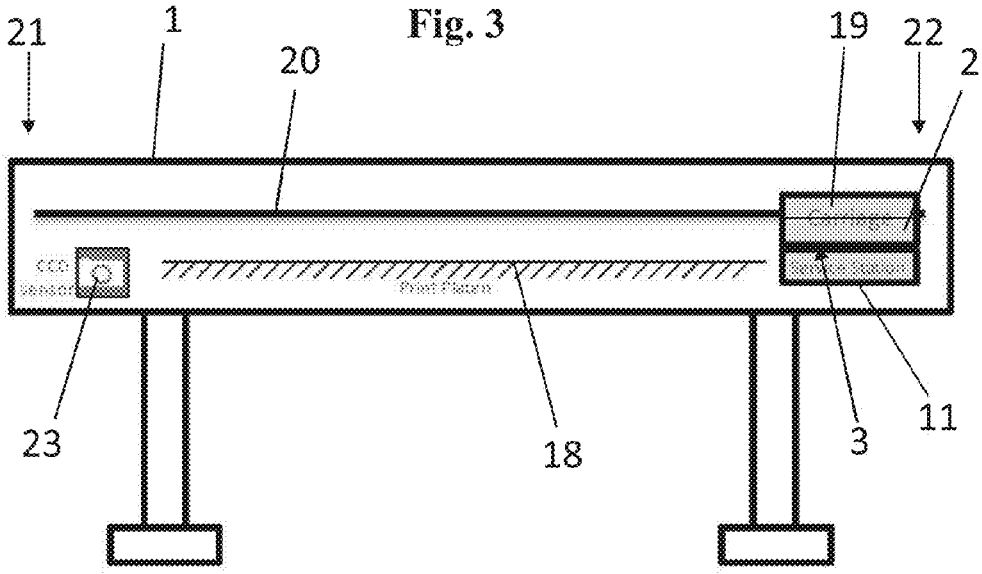
FIG. 4 shows the example of the printer of FIG. 3 in front view, in a second state.

FIG. 4 shows the printer 1 in another state. In FIG. 4 the printhead 2 has completed a full pass. The printhead 2 has moved towards the second end 22, to the service station 11, for a cleaning routine. The cleaning routine may be executed between print passes.

In an example, it is determined if unwanted artifacts such as for example paddles, fluids, crusts and/or dirt, are present on the nozzle plate 3. The printer circuit 5 (FIG. 1, 2) is configured to recognize artifacts in the digital image taken by the image sensor 23. For example, the printer circuit 5 may be configured to instruct execution of a cleaning routine if an area coverage of the artifacts with respect to a surface of the nozzle plate 3 is more than a predetermined threshold. This can be explained with reference to FIGS. 5-11.

Figure 5:
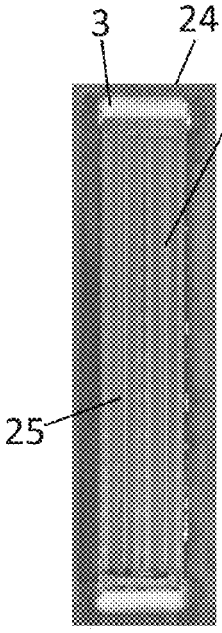
FIG. 5 shows an example of a reference image.

For example, FIG. 5 shows a reference digital image 24. The reference digital image 24 may be a monochrome or color picture of a clean and/or unused nozzle plate 3. The reference digital image 24 may represent a desired state of the nozzle plate 3. The nozzle plate 3 in the reference digital image 24 may be the same or of the same type as the nozzle plate 3 of the printer 1. The reference digital image 24 may be stored in the printer circuit 5, for example in the memory arrangement 7 and/or in the firmware of the printer 1. The shown nozzle plate example includes two nozzle arrays 25. Other examples may have different nozzle and nozzle array arrangements.

Figure 6:
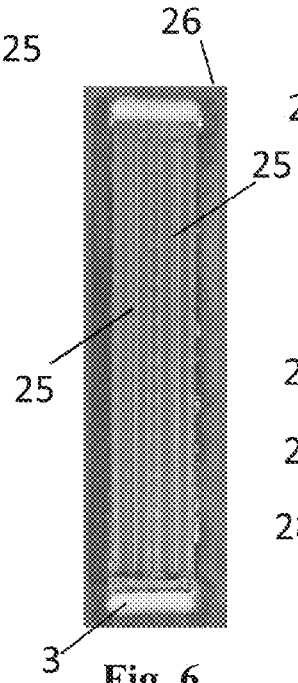
FIG. 6 shows an example of an image of a clean nozzle plate.

FIG. 6 shows a second digital image 26 of a clean nozzle plate 3 of the printer 1, for example before printing. The nozzle plate 3 in the second digital image 26 may be the same or of the same type as the nozzle plate 3 of the reference digital image 24. In an ideal state, the second digital image 26 would be equal to the reference digital image 24. In certain examples, there may be relatively small differences between the reference digital image 24 and the second digital image 26, for example because of manufacturing differences, wear, slight misalignment of the image sensor 23 or nozzle plate 3, or other circumstances.

Figure 7:
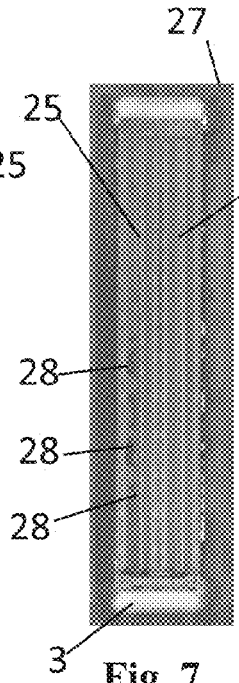
FIG. 7 shows an example of an image of the nozzle plate of FIG. 6 after six print passes.

FIG. 7 shows an example of a third digital image 27. The third digital image represents a nozzle plate 3 after printing. The shown third digital image 27 contains artifacts 28. For example, the shown artifacts 28 may be paddles, dirt, print fluids and/or crusts accumulated on the nozzle plate 3. For example, the artifacts 28 may be located close to the nozzle arrays 25.

Figure 8:
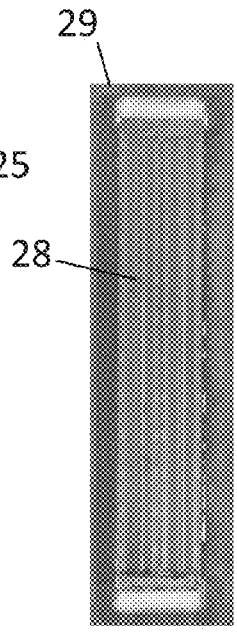
FIG. 8 shows an example of an image of the nozzle plate of FIGS. 6 and 7 after a cleaning routine.

FIG. 8 shows an example of a fourth digital image 29 of a nozzle plate 3 after a cleaning routine. For example, the nozzle plate 3 is depicted after a wiping routine. In an ideal scenario, the fourth digital image 29 would be as clean as the second digital image 26 and/or the reference digital image 24. In the shown example, relatively small artifacts 28 are left behind on the nozzle plate 3. For example, the shown artifacts 28 do not affect printing because they cover a relatively small area that would not visibly affect a printing result. In another example, the left over artifacts 28 could cover a larger area and could be perceived as to affect printing, even shortly after the clean routine would have been executed.

Figure 9:
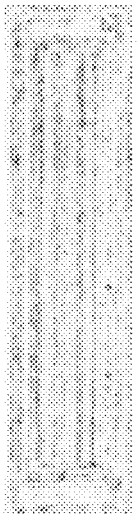
FIG. 9 shows an example of a result after comparing a digital image of the nozzle plate of FIG. 6 with the reference image of FIG. 5.

FIG. 9 images a result of comparing the second digital image 26 to the reference digital image 24. The comparison may have been done through equations and/or steps of an image processing algorithm. The image processing algorithm may be stored in the memory arrangement 7. In an example, the image processing algorithm includes a structural similarity (SSIM) algorithm or another algorithm based on the SSIM. In the example, the printer circuit 5 determines differences between the second digital image 26 and the reference digital image 24. In the figure, the determined differences are indicated in black regions and/or dots, while equal regions of the respective images 24, 26 may be left white. In the shown example, artifacts 28 may be represented by the black regions. In the shown example, there are relatively few artifacts 28 or no artifacts. For example, there is only a small amount of area covered by the black regions or dots, below a minimum amount that would point to artifacts 28. For example, the black regions or dots of FIG. 9 may relate to circumstances such as manufacturing differences or wear or a misalignments of the image sensor 23 or nozzle plate 3. In another example (not shown), the result of the comparison between the reference digital image 24 and the second digital image 26 of a clean nozzle plate 3, using the same image processing algorithm, would be a completely or substantially white picture.

Figure 10:
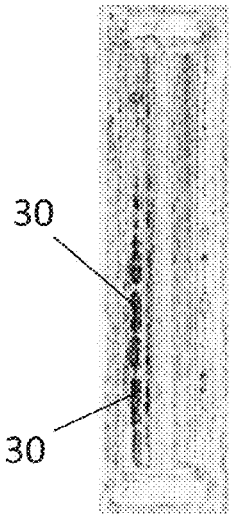
FIG. 10 shows an example of a result after comparing a digital image of the nozzle plate of FIG. 7 with the reference image of FIG. 5.

FIG. 10 images a result of comparing the third digital image 27 to the reference digital image 24, for example using the image processing algorithm, for example the SSIM algorithm or other algorithm based thereon. In the shown example, the differences between the third digital image 27 and the reference digital images 24 are indicated by black regions 30. The black regions 30 may represent artifacts 28. In an example, the control circuit 6 is configured to calculate an area coverage of the artifacts 28. The area coverage of the artifacts 28 may be represented in a relative coverage with respect to a larger surface, for example percentage of the nozzle plate surface or a part of the nozzle plate surface. The control circuit 6 may be configured to compare the calculated area coverage to a threshold. For example, the threshold may be represented by a percentage. For example, the threshold may be 0.5% or any other percentage. For example, if the black regions 30 that represent the artifacts 28 would cover approximately 0.6% of the surface of the nozzle plate 3, and the predetermined threshold for triggering a cleaning routine would be 0.5%, than a cleaning routine could be triggered by the printer circuit 5 because it is determined that too many artifacts 28 are accumulated on the nozzle plate 3. Other factors may be taken into account for determining if the amount of artifacts 28 would justify a cleaning routine or not. For example, the area coverage may involve a proximity of the artifacts 28 to the nozzles and/or a spreading of the artifacts 28 over the nozzle plate 3.

Figure 11:
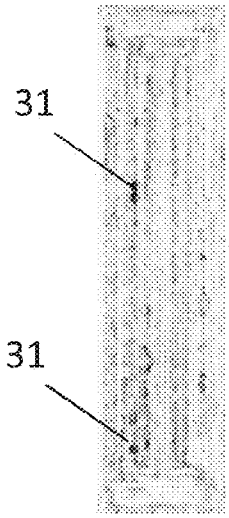
FIG. 11 shows an example of a result after comparing a digital image of the nozzle plate of FIG. 8 with the reference image of FIG. 5.

FIG. 11 images a result of comparing the fourth digital image 29 to the reference digital image 24, using the image processing algorithm. The fourth digital image 29 represents the nozzle plate 3 after a cleaning routine. The printer circuit 5 may be configured to determine differences between the reference digital image 24 and the fourth digital image 29. The differences are represented by second black regions 31. The second black regions 31 represent the detected artifacts 28. There are fewer second black regions in FIG. 11 31 than black regions 30 in FIG. 10 because at least a portion of the artifacts 28 was cleaned by the cleaning routine. The remaining black regions 31 may represent left over artifacts 28 or different artifacts 28 (FIG. 8) as compared to the artifacts 28 that were on the nozzle plate 3 before cleaning (FIG. 9). In an example (not shown), the nozzle plate 3 would be clean so that the fourth digital image 29 would be equal to the reference digital image 24, and the picture would be completely or substantially white.

In an example, a predetermined threshold of area coverage of the artifacts 28, used by the printer circuit 5 for deciding whether a cleaning routine needs to be executed, is approximately 1% or less of the surface of the nozzle plate 3, or for example 0.5% or less of the nozzle plate 3. Other thresholds may be used, for example if a picture is taken of only a part of the nozzle plate 3.

The printer circuit 5 may be configured to compare the calculated area coverage of the artifacts 28 with the threshold each time the image sensor 23 captures the digital image 26, 27, 29. For example, the image sensor 23 may capture the digital image 26, 27, 29 each time the printhead 2 passes near one of the respective ends 21, 22. In an example scenario, it may happen that when the first digital image 29 after a cleaning routine is processed, an area coverage of the artifacts 28 is determined to be higher than the threshold. This may trigger a second cleaning routine with only one there-and-back print passes in between. The same scenario may repeat itself several times unless there is an intervention algorithm. In an example, the printer circuit 5 is configured to trigger a message if after a predetermined number of subsequent cleaning routines the artifacts 28 still cover more than the threshold. For example, if three times in a row the fourth digital image 29 still shows over 1% area coverage of artifacts 28, the printer circuit 5 may trigger a message to an operator. In an example, the message may be a predetermined human readable or audible message to an operator to allow intervention or a service operation. Such message may be displayed and/or audibly communicated through the operator panel 9.

In an example subsequently executed cleaning routines may be cleaning routines with only one there-and-back print pass in between, or in other examples with only two, three or four there-and-back print passes in between.

The digital images (FIGS. 5-8) and plots of comparisons of the digital images (FIGS. 9-10) are representations of binary codes that could be used for comparison. In other examples, different colors, different images or different image processing methods could be used.

Figure 12:
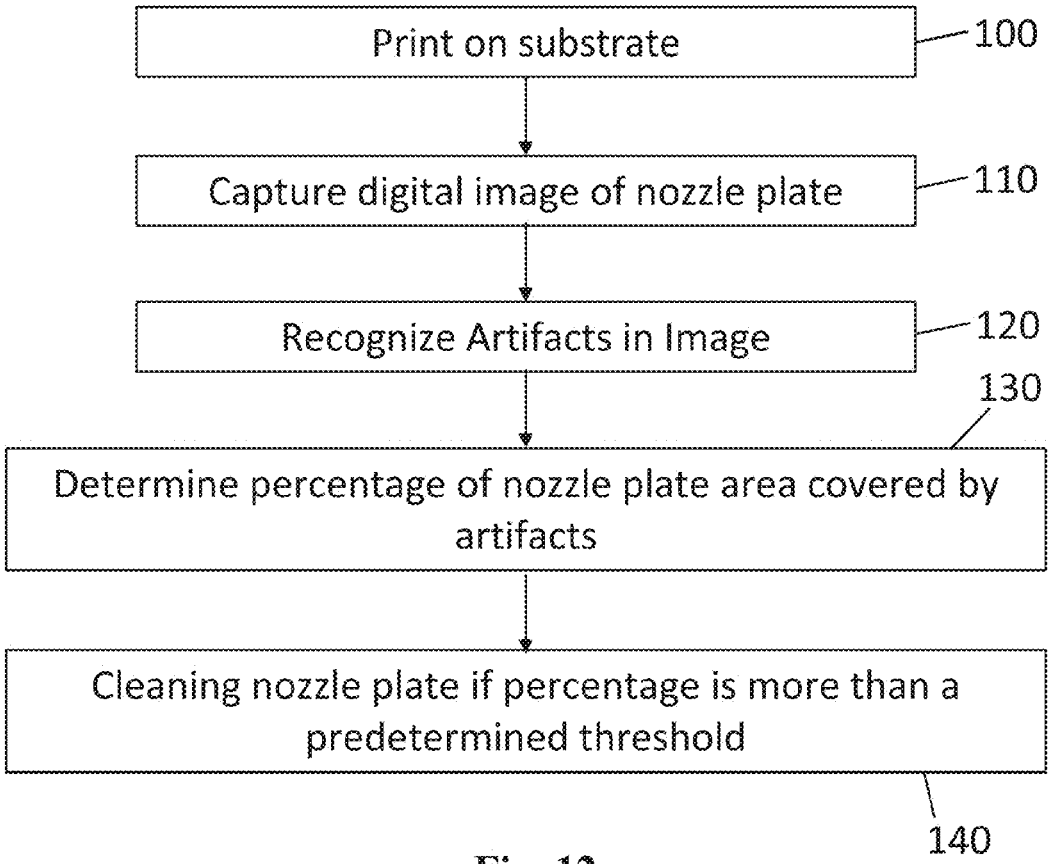
FIG. 12 shows a flow chart of an example of a method of printing.

FIG. 12 shows a flow chart of an example of a method of printing. In the method, a substrate 4 is printed (block 100). In the method, a digital image 27 of at least a part of a nozzle plate 3 is captured (block 110), for example by an image sensor 23 inside the printer 1. In the method, artifacts 28 in the digital image 27 are recognized (block 120). In the method, an area coverage of the artifacts 28 with respect to a surface of at least a part of the digital image 27 of at least a part of the nozzle plate 3 is determined (block 130). For example, the area coverage of the artifacts 28 may be a percentage of the full digital image 27, wherein the digital image 27 includes the full nozzle plate 3. In the method, the nozzle plate 3 is cleaned if the area coverage of the artifacts 28 is more than a predetermined threshold (block 140).

Figure 13:
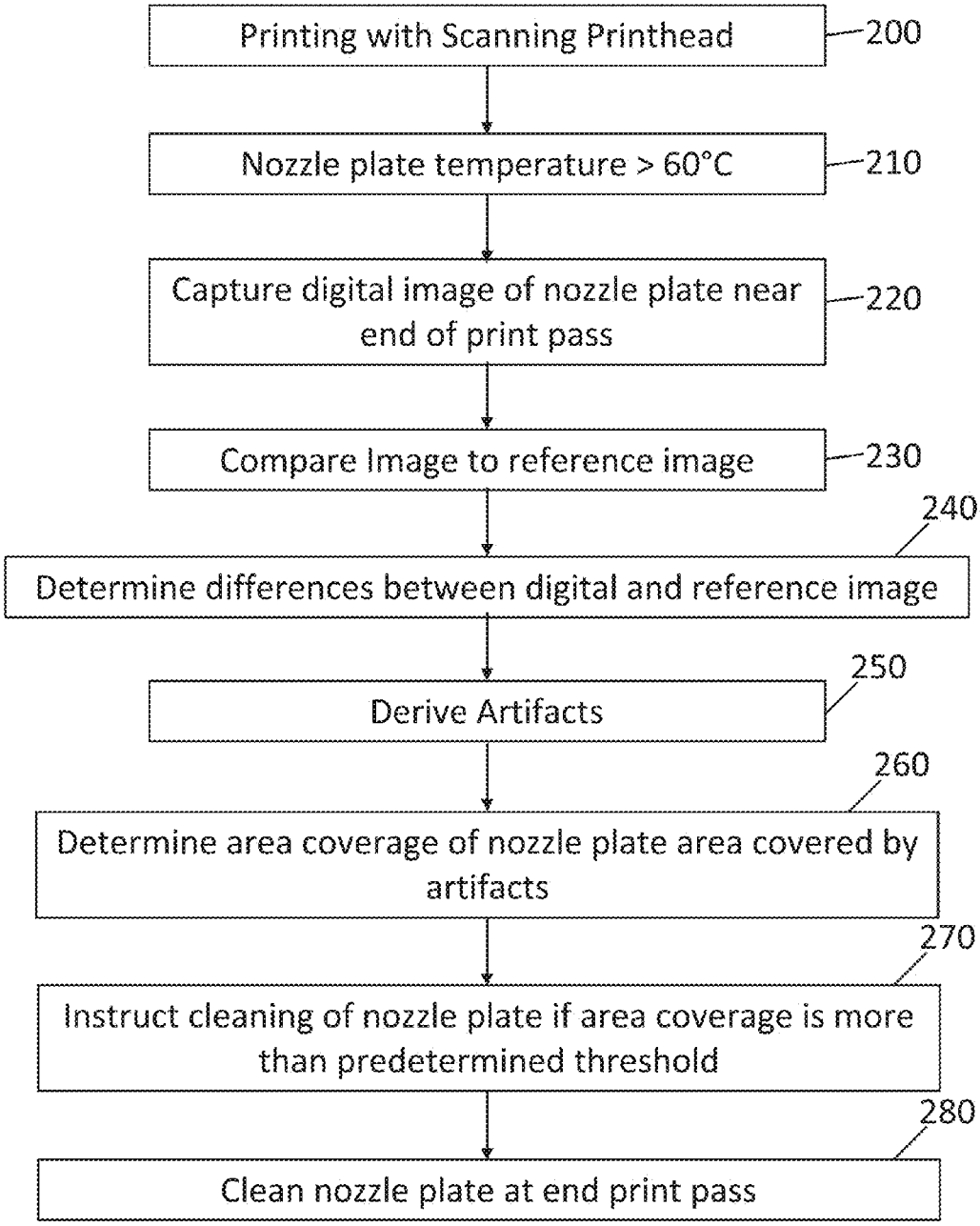
FIG. 13 shows a flow chart of another example of a method printing.

FIG. 13 shows a flow chart of another example of a print method. In the example method, a substrate 4 is printed by scanning the printhead 2 over the substrate 4 (block 200). In a further example, the nozzle plate 3 may reach temperatures of over approximately 60 degrees Celsius (block 210). For example, the nozzle plate may be intentionally or unintentionally heated through thermal resistors in TIJ printing and/or the print fluid may be irradiated by an irradiator 17. The example method includes capturing a digital image 27 of at least a part of the nozzle plate 3 near an end 21, 22 of a print pass of the printhead 2 (block 220). The example method includes comparing the digital image 27 to a reference image 24 stored in the memory arrangement 7 (block 230). The example method includes determining differences between the digital image 27 and the reference image 24, for example by image processing such as SSIM or a similar process (block 240). In an example, the differences may be represented by black regions 30, 31. The example method includes deriving the artifacts 28 from the found differences (block 250). The example method includes determining a percentage of the nozzle plate surface, or a part of the total nozzle plate surface, that is covered by the artifacts 28 (block 260). Instead of a percentage, also other area coverage may be calculated such as for example the area over which the artifacts are spread out, a proximity to the nozzles, etc. A percentage of the total nozzle plate 3 or a percentage of only a part of the nozzle plate 3 may be determined. The example method includes activating a cleaning routine of the nozzle plate 3 if the calculated area coverage of the artifacts 28 is more than a predetermined threshold (block 270). For example, the threshold may be a percentage such as 0.5% or 1% or any other number. The example method includes cleaning the nozzle plate 3 near a respective end 22 of the print pass (block 280), for example by activating the service station 11 and/or the wipers 12.

Figure 14:
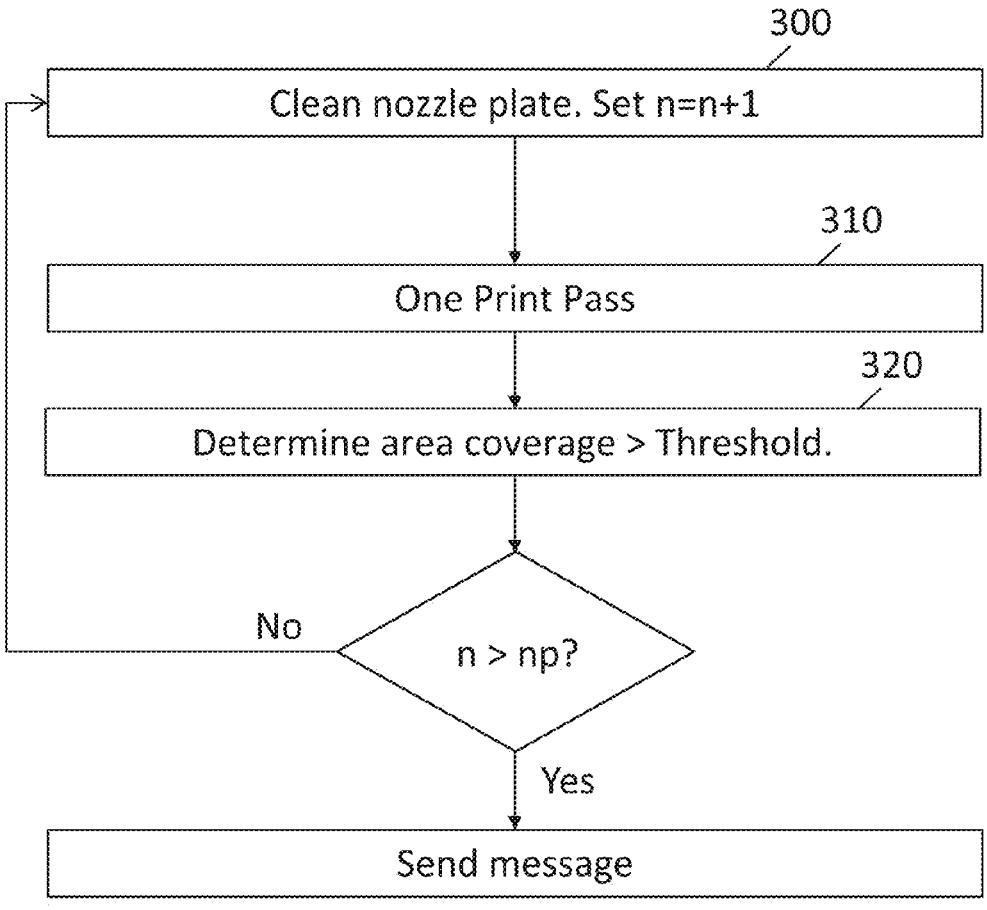
FIG. 14 shows a flow chart of another example of a method of triggering a message.

FIG. 14 shows an example of a method of triggering a human readable message if after a predetermined number of subsequent cleaning routines the artifacts 28 still cover more than said predetermined threshold. The example method may include cleaning the nozzle plate 3 (block 300). In an example, the printer circuit 5 includes a counter that counts subsequently executed cleaning routines. In an example subsequently executed cleaning routines may be cleaning routines with only one there-and-back print pass in between, or in other examples with only two, three or four there-and-back print passes in between. Cleaning of the nozzle plate 3 may set the counter count n to +1. In an example, the method includes executing one print pass (block 310) after cleaning, which will trigger capturing of the digital image 29. In an example, it is determined that the area coverage of the artifacts 28 in the digital image 29 is still more than the threshold (block 320). For example, a wiping of the nozzle plate 3 has not sufficiently cleaned off the artifacts 28 or there may be an image sensor error. The example method includes determining if the counted number n of subsequent cleaning routines that has been executed is larger than a predetermined number np (block 330). If the counted number n of subsequent cleaning routines exceed the predetermined number np, a message or alert is sent to the operator to allow the operator to intervene (block 340). If the subsequently executed cleaning routines do not exceed said predetermined number np, a new cleaning routine may be executed (block 300).

In a further aspect of this disclosure, a computer program product 10 is provided, comprising instructions for instructing a printer circuit 5 to recognize artifacts 28 in an input digital image 26, 27, 29 of at least a part of a nozzle plate 3, and trigger execution of a nozzle plate cleaning routine if the recognized artifacts 28 cover more than a predetermined area of the digital image 26, 27, 29. Here, the predetermined area is represented by the predetermined threshold.

Above described examples may allow for a maintenance and cleaning of the nozzle plate 3 inside the printer 1, during printing. By performing the optical check during printing, it may be prevented that cleaning routines are executed when they are not necessary. For example, when there are few or no artifacts 28 on the nozzle plate 3 a cleaning routine may be postponed. For example, cleaning routine decisions may be based on artifact area coverage, irrespective of measured nozzle plate temperature or firing frequencies. Less time may be lost on cleaning routines which may make printing more efficient. In an example, a lower exchange rate of certain parts of the service station 11 such as the cassette and/or wipers 12 may be achieved.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. Printer, comprising
a printhead nozzle plate,
a service station for cleaning the nozzle plate,
an image sensor configured to capture a digital image of at least a part of the nozzle plate, and
a printer circuit, comprising a control circuit for controlling the printhead and the service station, and a memory arrangement,
wherein the printer circuit is configured to
recognize artifacts located on the nozzle plate in the digital image, and
instruct execution of a nozzle plate cleaning routine if an area coverage of the recognized artifacts located on the nozzle plate with respect to a total surface of at least a part of the digital image is more than a predetermined threshold.

2. Printer according to claim 1, wherein the predetermined threshold is approximately 1% of the nozzle plate surface or less.

3. Printer according to claim 1, wherein the memory arrangement stores a reference image and the printer circuit is configured to
compare the digital image to a reference image, and
recognize differences between the digital image and the reference image, wherein the differences represent artifacts.

4. Printer according to claim 1, wherein the printer circuit is configured to trigger a predetermined human readable message meant for an operator if after a predetermined number of subsequently executed cleaning routines the artifacts area coverage is more than said predetermined threshold.

5. Printer according to claim 1, comprising a scanning printhead and a scanning axis, wherein the image sensor is arranged near an end of the scanning axis.

6. Printer according to claim 5, wherein the printer circuit is configured to trigger the image sensor to take a digital image of at least a part of the nozzle plate when the nozzle plate is near a respective end of a print pass.

7. Printer according to claim 1, comprising
said nozzle plate, and
thermal resistors for ejecting fluid through nozzles of the nozzle plate.

8. Printer according to claim 1, comprising a scanning printhead and an irradiation module arranged to irradiate fluid relatively shortly after ejection from the nozzle plate.

9. Printer according to claim 1, wherein at least a part of the service station is replaceable, which part includes a wiper for wiping the nozzle plate.

10. Method of printing, comprising
printing,
capturing a digital image of at least a part of a nozzle plate,
recognizing artifacts on the nozzle plate from the digital image,
determining an area coverage of the recognized artifacts with respect to a surface of at least a part of the digital image, and
cleaning the nozzle plate if the area coverage of the artifacts is more than a predetermined threshold.

11. Method according to claim 10, comprising
comparing the digital image to a reference image stored in a memory arrangement, and
determining differences between the digital image and the reference image through image processing, wherein the differences represent the artifacts.

12. Method according to claim 10, comprising triggering a human readable message if after a predetermined number of subsequently executed cleaning routines the artifacts still cover more than said predetermined threshold.

13. Method according to claim 10, comprising
during printing, scanning the printhead over a substrate,
taking the digital image near an end of a print pass, and
cleaning the nozzle plate near an end of the print pass.

14. Method according to claim 10, comprising heating a print fluid, wherein during printing the nozzle plate reaches temperatures over 60 degrees Celsius.

15. A non-transitory computer readable medium having computer executable instructions for instructing a printer circuit to
recognize artifacts on a nozzle plate in an input digital image of at least a part of the nozzle plate, and
trigger execution of a nozzle plate cleaning routine if the recognized artifacts cover more than a predetermined area of the digital image.

* * * * *